US008368010B2

(12) United States Patent
Kawana

(10) Patent No.: US 8,368,010 B2
(45) Date of Patent: Feb. 5, 2013

(54) QUADRUPOLE MASS SPECTROMETER

(75) Inventor: Shuichi Kawana, Osaka (JP)

(73) Assignee: Shimadzu Corporation, Kyoto (JP)

( * ) Notice: Subject to any disclaimer, the term of this patent is extended or adjusted under 35 U.S.C. 154(b) by 294 days.

(21) Appl. No.: 12/550,055

(22) Filed: Aug. 28, 2009

(65) Prior Publication Data

US 2010/0065731 A1 Mar. 18, 2010

(30) Foreign Application Priority Data

Sep. 12, 2008 (JP) ..... 2008-234264

(51) Int. Cl.
*H01J 49/26* (2006.01)

(52) U.S. Cl. ..... 250/282; 250/281; 250/286

(58) Field of Classification Search ..... 250/281–300, 250/489, 396 R; 315/500
See application file for complete search history.

(56) References Cited

U.S. PATENT DOCUMENTS 6,730,903 B2 * 5/2004 Kawato ..... 250/292
7,277,799 B2 * 10/2007 Park ..... 702/23
2006/0016985 A1 * 1/2006 Roushall et al. ..... 250/292
2008/0078926 A1 * 4/2008 Russ, IV et al. ..... 250/282
2010/0084552 A1 * 4/2010 Kawana ..... 250/288
2010/0200746 A1 * 8/2010 Osgood et al. ..... 250/282
2011/0073756 A1 * 3/2011 Mukaibatake et al. ..... 250/290
2011/0101221 A1 * 5/2011 Mukaibatake et al. ..... 250/292
2011/0133075 A1 * 6/2011 Hashimoto et al. ..... 250/283

FOREIGN PATENT DOCUMENTS

JP 04-289652 A 10/1992
JP 2000-195464 A 7/2000

* cited by examiner

*Primary Examiner* — Robert Kim
*Assistant Examiner* — Wyatt Stoffa
(74) *Attorney, Agent, or Firm* — Sughrue Mion, PLLC

(57) ABSTRACT

A quadruple mass spectrometer capable of reducing a settling time-period necessary in a process of changing, in a pulsed or step-like pattern, a voltage to be applied to a quadruple mass filter in a scan or SIM measurement. In the SIM measurement, an optimal settling-time calculation sub-section sets a length of the settling time-period according to a difference ΔM between a next-measurement mass value and a mass value used in an adjacent measurement, and the next-measurement mass value. This makes it possible to shorten a duration of a repetitive cycle in the SIM measurement or increase a time-period assignable to a measurement operation, while ensuring a voltage stabilization time-period sufficient to detect ions having the next-measurement mass value.

2 Claims, 5 Drawing Sheets

Example of settling-time setting table

| | | Mass-value difference ΔM | | |
|---|---|---|---|---|
| | | 0 - 99 | 100 - 299 | 300 - |
| Post-change mass value | 2 - 49 | 3 (ms) | 4 | 5 |
| | 50 - 99 | 2 | 3 | 4 |
| | 100 - 1090 | 1 | 2 | 4 |

Example of settling-time setting table

| | | Mass-value difference ΔM | | |
|---|---|---|---|---|
| | | 0 - 99 | 100 - 299 | 300 - |
| Post-change mass value | 2 - 49 | 3 (ms) | 4 | 5 |
| | 50 - 99 | 2 | 3 | 4 |
| | 100 - 1090 | 1 | 2 | 4 |

Stabilization time in change in m/z: 569 → 69
(Mass-value difference: 500)

Stabilization time in change in m/z: 719 → 219
(Mass-value difference: 500)

QUADRUPOLE MASS SPECTROMETER

BACKGROUND OF THE INVENTION

1. Field of the Invention

The present invention relates to a quadrupole mass spectrometer using a quadrupole mass filter as a mass analyzer operable to separate ions according to mass values (exactly, m/z (mass-to-charge ratio) values).

2. Description of the Background Art

A quadrupole mass spectrometer is designed to apply a voltage formed by superimposing a high-frequency (radio-frequency) voltage on a direct-current (DC) voltage, to four rod electrodes constituting a quadrupole mass filter, to allow only an ion having a mass corresponding to the applied voltage to selectively pass through the quadrupole mass filter and reach an ion detector. Recent years, a gas chromatograph/mass spectrometer (GC/MS) and a liquid chromatograph/mass spectrometer (LC/MS) produced by combining the quadrupole mass spectrometer with respective ones of a gas chromatograph and a liquid chromatograph are widely used in various fields.

A scan measurement and a selected ion monitoring (SIM) measurement are well known as a measurement mode of the quadrupole mass spectrometer. The scan measurement is configured to repetitively perform a control/processing of scanning (continuously changing) a voltage to be applied to the rod electrodes of the quadrupole mass filter, so as to scan (continuously change) a mass value for an ion to be allowed to reach to the ion detector, over a given mass range. The scan measurement shows excellent ability, particularly, in qualitative analysis for a sample containing a substance whose mass is unknown. The SIM measurement is configured to repetitively perform mass analysis for ions having ones of a plurality of mass values pre-set by a user, while sequentially changing between the plurality of mass values. The SIM measurement shows excellent ability, particularly, in quantitative analysis for a substance whose mass is known.

FIG. 6 is a schematic diagram showing a change in mass value for a target ion to be analyzed, during the scan measurement. As shown in FIG. 6, in order to allow respective target ions to pass through the quadrupole mass filter, a voltage to be applied to the rod electrodes of the quadrupole mass filter is gradually increased from a voltage value corresponding to a minimum mass value M1. Then, after the voltage reaches a voltage value corresponding to a maximum mass value M2, the voltage is rapidly returned to the voltage value corresponding to the minimum mass value M1, and a next voltage scan (mass scan) cycle will be performed in the same manner. Such a rapid voltage change inevitably causes overshoot (or undershoot) and ringing. Thus, a waiting time-period (settling time-period) is provided just after the voltage change to continue until the voltage becomes moderately stable, and, after an elapse of the settling time-period, a next voltage scan (mass scan) cycle is started to perform a substantial ion detection operation, i.e., a measurement operation.

In the SIM measurement, during a course of changing from a certain one to a different one of the plurality of mass values, the above overshoot (or undershoot) and ringing in voltage inevitably occur, as with the scan measurement. Thus, it is necessary to provide a settling time-period just after a voltage change, and, after an elapse of the settling time-period, perform a substantial ion detection (measurement) operation for the mass value corresponding to an applied voltage after the voltage change. For example, the following Patent Publication 1 includes a description that it is essential to provide a settling time-period in the SIM measurement.

In both the scan measurement and the SIM measurement, during the settling time-period, any mass analysis for components of a sample introduced from a GC or LC into an ion source is not performed. Thus, for example, in the scan measurement, as the settling time-period becomes longer, a time interval between adjacent mass scan cycles becomes larger, i.e., a duration of one mass scan cycle becomes longer, to cause deterioration in time resolution. In the SIM measurement, as the settling time-period becomes longer, a time interval between measurements for a respective one of the mass values in adjacent cycles becomes larger to cause deterioration in time resolution. Although a duration of the repetitive cycle may be shortened to enhance the time resolution, it causes a reduction in ion detection (measurement) time-period for each of the mass values, which leads to deterioration in sensitivity and SN ratio.

In a mass spectrometer disclosed in the following Patent Document 2, when a voltage to be applied to rod electrodes of a quadruple mass filter is changed in a step-like pattern to change a mass value for a target ion in a step-like pattern, a waiting time-period (settling time-period) before performing an ion detection (measurement) operation is controllably changed depending on a voltage difference between adjacent ones of the steps. This control makes it possible to reduce a total of the settling time-periods to increase a measurement time-period, as compared with a technique where each of the settling time-periods is set to a constant value assuming a maximum settling time-period. However, there remains a need for further reducing the settling time-period achievable by the conventional control, to enhance time resolution and sensitivity/SN ratio.

[Patent Document 1] JP 2000-195464A

[Patent Document 2] JP 4-289652A

SUMMARY OF THE INVENTION

In view of the above circumstances, it is an object of the present invention to provide a quadrupole mass spectrometer capable of, during a scan measurement, an SIM measurement or the like, maximally reducing a settling time-period having no substantial contribution to mass analysis, to shorten a duration of a repetitive cycle to enhance time resolution, and increase a substantial ion detection time to enhance SN ratio and sensitivity.

In order to achieve this object, the present invention provides a quadruple mass spectrometer equipped with a quadrupole mass filter for allowing an ion having a specific mass to selectively pass therethrough and a detector for detecting the ion passing through the quadrupole mass filter, and designed to perform one of: a scan measurement configured to continuously change a mass value for an ion to be allowed to pass through the quadrupole mass filter, over a given mass range, in a repetitive manner; a selected ion monitoring (SIM) or multiple reaction monitoring (MRM) measurement configured to carry out a cycle of operation to sequentially change between a plurality of pre-set mass values, in a repetitive manner; and an alternate measurement configured to alternately carry out the scan measurement and the SIM or MRM measurement. The quadruple mass spectrometer comprises (a) quadrupole driving means operable to apply a given voltage to four electrodes constituting the quadrupole mass filter, and (b) control means operable, during one of the scan measurement, the SIM or MRM measurement and the alternate measurement, to control the quadrupole driving means in such a manner as to change the voltage to be applied to the electrodes of the quadrupole mass filter, according to a discrete change in mass value, while changing a length of a waiting time-period from just after the discrete change through until a substantial ion detection operation is started, based on a difference between respective mass values before and after the discrete change, and the mass value after the discrete change.

The quadruple mass spectrometer of the present invention includes a triple quadrupole mass spectrometer capable of MS/MS analysis. In this case, the MRM measurement can be performed.

When the scan measurement is performed in the quadruple mass spectrometer of the present invention, a scan-start mass value and a scan-end mass value are given as a parameter. Then, in one mass scan cycle started just after completion of an adjacent mass scan cycle, a difference between the scan-start mass value and the scan-end mass value is calculated as a difference between respective mass values before and after a discrete change in mass value at a time when a certain mass scan cycle is completed and a next mass scan cycle is started (this difference will hereinafter be referred to as "mass-value difference" in the scan measurement). When the SIM or MRM measurement is performed in the quadruple mass spectrometer of the present invention, a plurality of different mass values are designated as a parameter. Then, a difference between a certain one of the mass values, and a specific one of the remaining mass values, which will be used for analysis (ion separation) to be performed just after completion of analysis using the certain mass value is calculated as a difference between respective mass values before and after a discrete change in mass value (this difference will hereinafter be referred to as "mass-value difference" in the SIM or MRM measurement). In each of the scan measurement and the SIM or MRM measurement, the mass value after the discrete change in mass value (hereinafter referred to as "post-change mass value" or "next-measurement mass value") is obtained from the parameter.

The control means is operable to determine the length of the waiting time-period (settling time-period) based on the mass-value difference and the post-change mass value obtained in the above manner. In a specific embodiment, the control means is operable to allow the waiting time-period to become shorter as the difference between respective mass values before and after the discrete change in mass value (i.e., mass-value difference) becomes smaller. Specifically, when the mass-value difference is relatively small, a change in the applied voltage to the electrodes of the quadruple mass filter is also relatively small. Consequently, a level of overshoot (undershoot) and ringing just after a rapid voltage change is relatively low, and therefore the voltage will become stable within a relatively short period of time.

In another specific embodiment, the control means is operable to allow the waiting time-period to become shorter as the mass value after the discrete change in mass value (i.e., post-change mass value) becomes larger. Specifically, when the post-change mass value is relatively large, a target ion having such a mass value is less affected by disorder in electric field due to overshoot (undershoot) and ringing, and the applied voltage to the electrodes of the quadruple mass filter is also relatively large, i.e., a level of overshoot (undershoot) and ringing is relatively low. Therefore, the voltage just after the rapid voltage change will become stable within a relatively short period of time.

In case where the mass value is changed in a step-like pattern, the quadruple mass spectrometer of the present invention can set each of a plurality of waiting time-periods required for stabilizing an applied voltage to the quadruple mass filter, to the shortest value or a value close thereto, according to an amount of the change (i.e., mass-value difference) and a post-change mass value. In other words, even if each of the waiting time-periods is shortened, the ion detection (measurement) operation can be performed under a condition that the applied voltage to the quadrupole mass filter is in a sufficiently stable state.

As above, in case where an applied voltage to the quadrupole mass filter is discretely changed in the scan measurement or the SIM or MRM measurement, the quadruple mass spectrometer of the present invention can further reduce an excessive unnecessary part of a waiting time-period, as compared with the conventional control. Thus, for example, in the scan measurement, even if a mass scan speed is set to a constant value, a duration of the repetitive cycle of mass scan can be shortened in such a manner as to reduce a time-period where no mass analysis data is obtained, so-called "dead time", to enhance time resolution. In the SIM or MRM measurement, even if a measurement time-period for each of the plurality of mass values are set to a constant value, a duration of the repetitive cycle of measurement for the plurality of mass values can be shortened in such a manner as to reduce a dead time, to enhance time-resolution. Further, in case where the duration of the repetitive cycle is not shortened, a time-period assignable to the ion detection (measurement) operation in one cycle is substantially increased, so that sensitivity and SN ratio can be enhanced.

DESCRIPTION OF THE EXEMPLARY EMBODIMENTS

Figure 1:
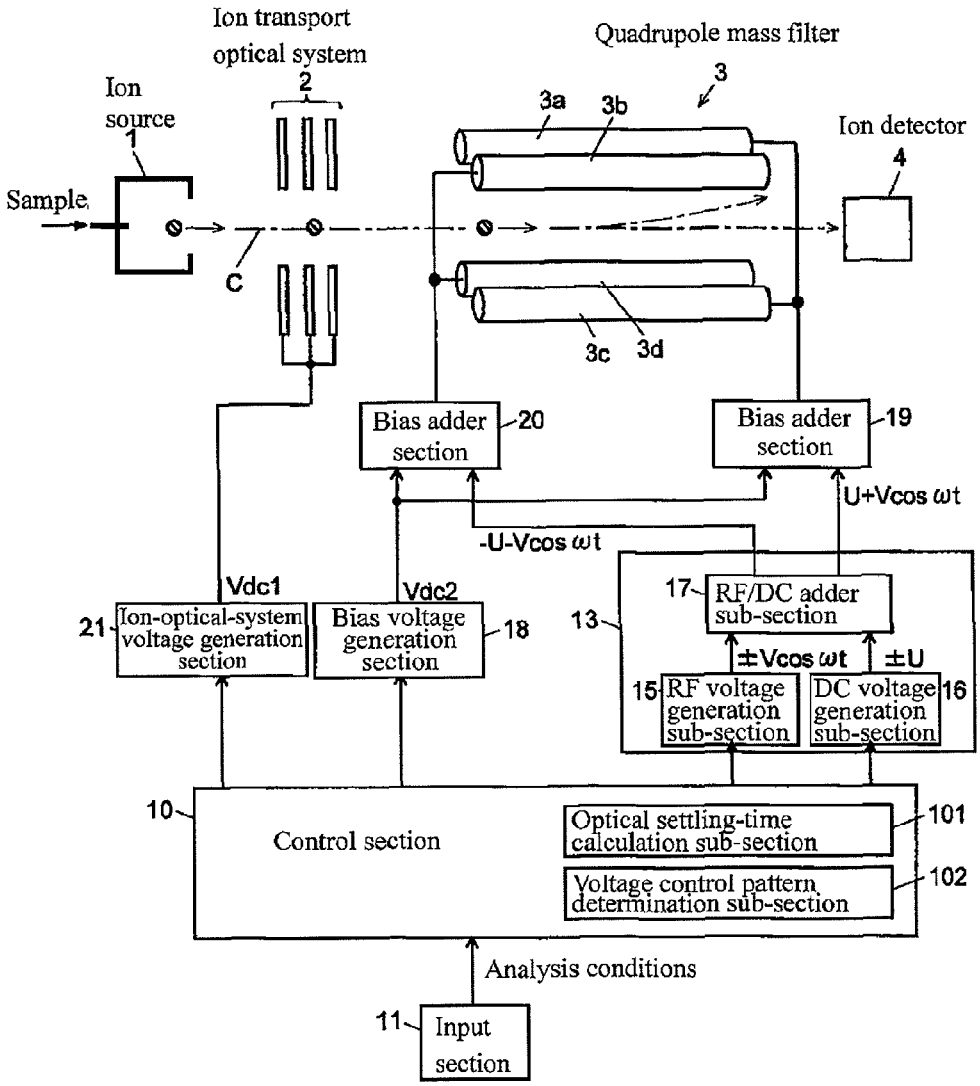
FIG. 1 is a fragmentary block diagram showing a quadruple mass spectrometer according to one exemplary embodiment of the present invention.

With reference to the accompanying drawings, the present invention will now be described based on one exemplary embodiment thereof. FIG. 1 is a fragmentary block diagram showing a quadruple mass spectrometer according to this embodiment.

The quadruple mass spectrometer according to this embodiment comprises an ion source 1, an ion transport optical system 2, a quadrupole mass filter 3 and an ion detector 4, which are installed inside a vacuum chamber (not shown). The quadrupole mass filter 3 includes four rod electrodes 3*a*, 3*b*, 3*c*, 3*d* each disposed to be inscribed in a circular cylindrical plane having an axis defined by an ion optical axis C and a given radius with a center on the axis. The four rod electrodes 3*a*, 3*b*, 3*c*, 3*d* are arranged to form two pairs each disposed in opposed relation across the ion optical axis C (i.e., the pair of rod electrodes 3*a*, 3*c* and the pair of rod electrodes 3*b*, 3*d*), and each of the pair of rod electrodes 3*a*, 3*c* and the pair of rod electrodes 3*b*, 3*d* are electrically connected together. The quadruple mass spectrometer also comprises an ion-selecting voltage generation section 13, a bias voltage generation section 18 and two bias adder sections 19, 20, which collectively serve as quadruple driving means operable to apply a voltage to the four rod electrodes 3*a*, 3*b*, 3*c*, 3*d*. The ion-selecting voltage generation section 13 includes a direct-current (DC) voltage generation sub-section 16, a radio-frequency (RF) voltage generation sub-section 15 and a radio-frequency/direct-current (RF/DC) adder sub-section 17.

Although not illustrated, a gas chromatograph (GC) is connected to an upstream side of the quadruple mass spectrometer, and a gaseous sample having components separated through a column of the GC is introduced into the ion source 1. Alternatively, a liquid chromatograph (LC) may be connected to the upstream side of the quadruple mass spectrometer. In this case, an atmospheric pressure ion source, such as an electrospray ion source, may be used as the ion source 1, and a multistage differential evacuation system may be employed to maintain an internal atmosphere of each of the quadrupole mass filter 3 and the ion detector 4 in a high-vacuum state, while maintaining an internal atmosphere of the ion source 1 in an approximately atmospheric state.

Further, the quadruple mass spectrometer comprises an ion-optical-system voltage generation section 21 operable to apply a DC voltage Vdc1 to the ion transport optical system 2 on an upstream side of the quadrupole mass filter 3, and a control section 10 operable to control respective operations of the ion-optical-system voltage generation section 21, the ion-selecting voltage generation section 13, the bias voltage generation section 18 and other sections and sub-sections. The control section 10 is connected with an input section 11 for allowing a user or operator to perform an input operation therethrough. Functions of the control section 10 and a data processing section (not shown) are achieved primarily by a computer comprising a CPU and a memory.

In the ion-selecting voltage generation section 13, the DC voltage generation sub-section 16 is operable, under control of the control section 10, to generate two DC voltages±U which are different in polarity. The RF voltage generation sub-section 15 is operable, under control of the control section 10, to generate two RF voltages $\pm V\cdot\cos\omega t$ which are out of phase by 180°. The RF/DC adder sub-section 17 is operable to add the DC voltages ±U and the RF voltages $\pm V\cdot\cos\omega t$ together to generate dual voltages $U+V\cdot\cos\omega t$ and $-(U+V\cdot\cos\omega t)$. This dual voltages serve as ion-selecting voltages which determine a mass (exactly, m/z ratio) of an ion to be allowed to pass through the quadrupole mass filter 3.

The bias voltage generation section 18 is operable to generate a DC bias voltage Vdc2 to be commonly applied to respective ones of the rod electrodes 3*a* to 3*d*, in such a manner that a voltage difference between the DC bias voltage Vdc2 and the DC voltage Vdc1 to be applied to the ion transport optical system 2 is set at a value suitable for forming a DC electric field on an immediate upstream side of the quadrupole mass filter 3 to allow ions to be efficiently introduced into a space of the quadrupole mass filter 3 in a longitudinal direction thereof. The bias adder section 19 is operable to add the ion-selecting voltage $U+V\cdot\cos\omega t$ and the DC bias voltage Vdc2 to form a voltage Vdc2$+U+V\cdot\cos\omega t$, and apply the formed voltage to the rod electrodes 3*a*, 3*c*, and the bias adder section 20 is operable to add the ion-selecting voltage$-(U+V\cdot\cos\omega t)$ and the DC bias voltage Vdc2 to form a voltage Vdc2$-(U+V\cdot\cos\omega t)$, and apply the formed voltage to the rod electrodes 3*b*, 3*d*. Each of the DC bias voltages Vdc1, Vdc2 may be set at an optimal value through an automatic tuning to be performed using a standard sample, etc.

Figures 2, 3:
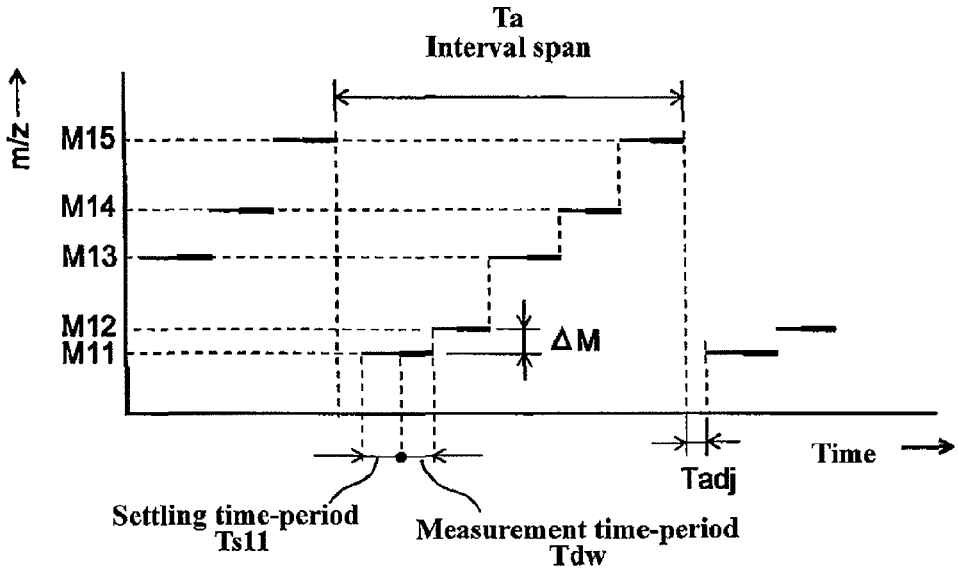
FIG. 2 is a chart schematically showing a relationship between a mass-value change and a settling time-period in an SIM measurement.
FIG. 3 is a table showing one example of a settling time-period setting table.

With reference to FIGS. 2, 3 and 5, a distinctive control operation for an SIM measurement in the quadruple mass spectrometer according to this embodiment will be described below.

The control section 10 includes an optimal settling-time calculation sub-section 101 which pre-stores therein a settling-time setting table as shown in FIG. 3. The settling-time setting table is designed to output an optimal settling time using an after-mentioned mass-value difference ΔM and an after-mentioned post-change mass value as an input. Specifically, under a condition that the post-change mass value is constant, the settling time-period becomes shorter as the mass-value difference ΔM becomes smaller. Further, under a condition that the mass-value difference ΔM is constant, the settling time-period becomes shorter as the post-change mass value becomes larger. In this example, when the mass-value difference ΔM is in the range of zero to 99, and the post-change mass value is in the range of 100 to 1090, the settling time-period is set to a shortest value of 1 ms. Differently, when the mass-value difference ΔM is equal to or greater than 300, and the post-change mass value is in the range of 2 to 49, the settling time-period is set to a longest value of 5 ms.

Under the condition that the post-change mass value is constant, when the mass-value difference ΔM is relatively small, a change in each of the applied voltages U, V to the rod electrodes 3*a* to 3*d* is also relatively small. Consequently, a level of undershoot (overshoot) and ringing is also relatively low, and therefore the applied voltage will become stable within a relatively short period of time. This is a reason why the settling time-period is controlled to become shorter as the mass-value difference ΔM becomes smaller under the condition that the post-change mass value is constant. Further, under the condition that the mass-value difference ΔM is constant, when the post-change mass value is relatively large, each of the applied voltages U, V to the rod electrodes is also relatively high. Consequently, even if undershoot (overshoot) and ringing occur at the same level when the applied voltage is rapidly changed from a certain value, an influence thereof becomes relatively smaller. In addition, sensitivity of an ion to a voltage (electric field) varies depending on a mass of the ion. Specifically, an ion having a larger mass is less affected by fluctuation in voltage (electric field). Therefore, under the condition that the mass-value difference ΔM is constant, the settling time-period can be set to become shorter as the post-change mass value becomes larger.

Figure 5A:
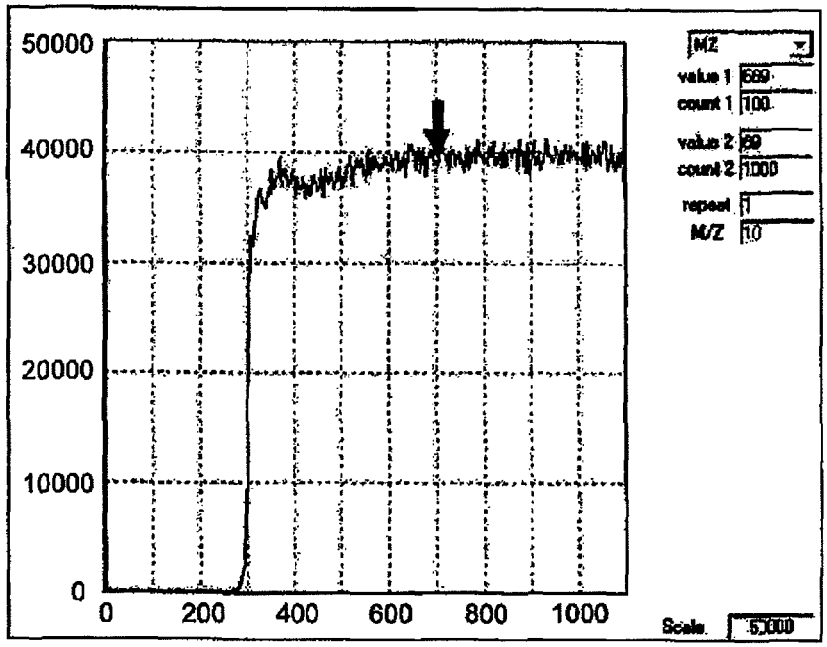
FIGS. 5A and 5B are graphs showing a result of comparison between respective stabilization times in two tests where a mass-value difference is set identically therebetween, and a post-change mass value is set differently therebetween.
Figure 5B:
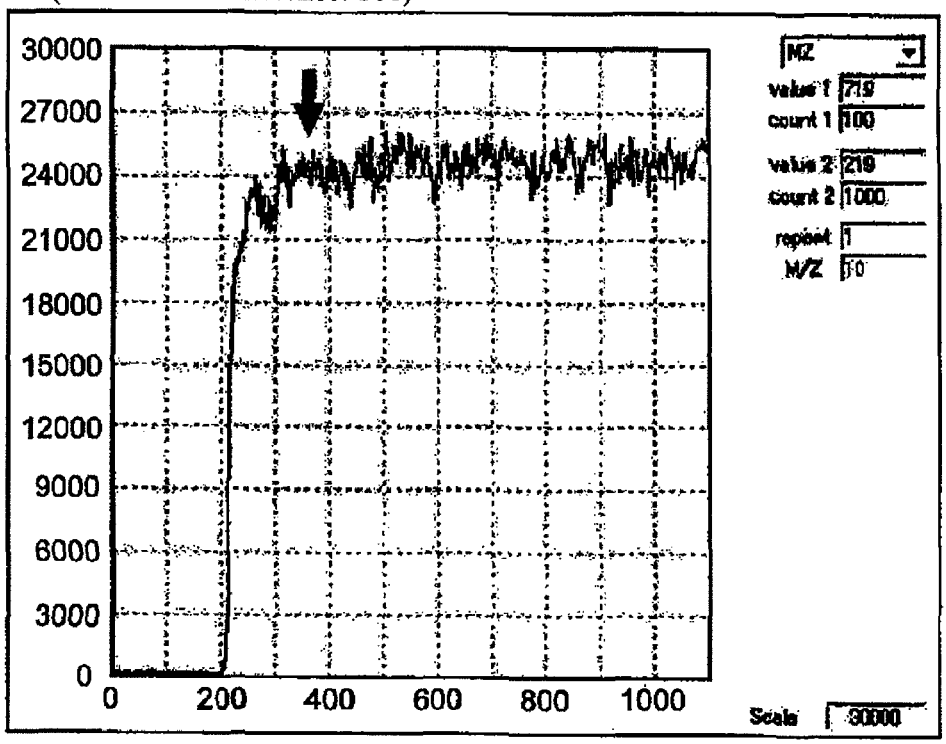
Figure 6:
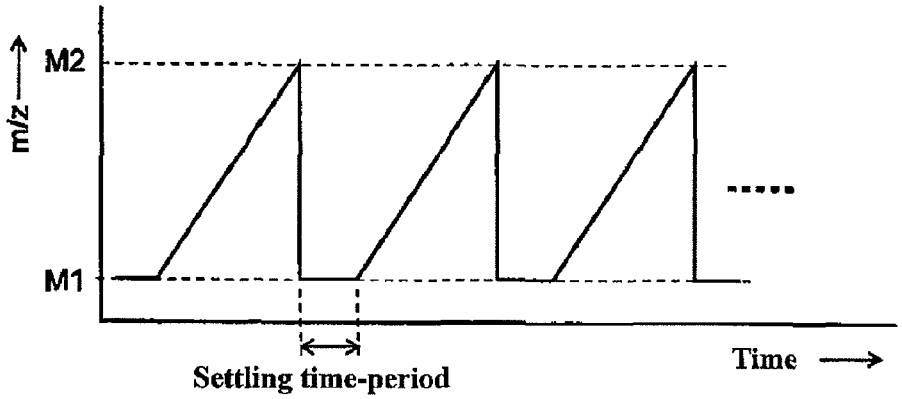
FIG. 6 is a chart schematically showing a mass-value change in a scan measurement

FIGS. 5A and 5B are graphs showing actual measurement results on ion detection intensity just after a change in mass value, in two tests where the mass-value difference is set identically therebetween (specifically, 500), and the post-change mass value is set differently therebetween. In FIGS. 5A and 5B, the downwardly-directed arrow points an assumed time point when an applied voltage to a quadrupole mass filter becomes stable to form a stable electric field. The actual measurement results also verify that the settling time-period can be set to become shorter as the post-change mass value becomes larger.

In the SIM measurement, in advance to issuing an instruction on start of the SIM measurement, a user uses the input section 11 to input and designate, as analysis conditions, a plurality of different mass (m/z ratio) values, and an interval span Ta which is a duration of one of a plurality of cycles of operation to repetitively perform measurements for the mass values. In response to this input, the optimal settling-time calculation sub-section 101 of the control section 10 calculates a mass-value difference ΔM, i.e., a difference between a first one of the designated mass values, and a second one of the remaining mass values which is used for a measurement to be performed just before a measurement for the first mass value, and then cross-checks the calculated mass-value difference ΔM and each of the mass values (as a next-measurement mass value) with the settling time-period setting table to derive a settling time-period corresponding to them, from the settling time-period setting table.

As one example, given that the mass values for use in the measurement consist of five mass values M11, M12, M13, M14, M15, and a measurement is performed for each of the five mass values in ascending order. In this case, a settling time-period TS12 just before a measurement for the mass value M12 is determined based on the mass value M12 and a mass-value difference ΔM=M12−M11, and a settling time-period TS13 just before a measurement for the mass value M13 is determined based on the mass value M13 and a mass-value difference ΔM=M13−M12. Further, a settling time-period TS14 just before a measurement for the mass value M14 is determined based on the mass value M14 and a mass-value difference ΔM=M14−M13, and a settling time-period TS15 just before a measurement for the mass value M15 is determined based on the mass value M15 and a mass-value difference ΔM=M15−M14. A settling time-period TS11 just before a measurement for the mass value M11 is determined based on the mass value M11 and a mass-value difference ΔM=M15−M11. Thus, the settling time-period is set to a longer value as the mass-value difference ΔM becomes larger. Further, the settling time-period is set to a longer value as the next-measurement mass value becomes smaller.

Then, the voltage control pattern determination sub-section 102 calculates a preliminary measurement time-period Tdw' for each of the designated mass values, based on the interval span Ta, the settling time-periods TS11, TS12, TS13, TS14, TS15, and the number n of the designated mass values (in this example, five), according to the following formula:

$$Tdw'[ms]=\{Ta-(TS11++TS12+TS13+TS14+TS15)\}/n$$

Then, the voltage control pattern determination sub-section 102 integerizes the preliminary measurement time-period Tdw' to set an obtained integer value as a final measurement time-period Tdw and set a remainder resulting from the integerization, as an inter-interval waiting time-period Tadj. Through the above operation, a time chart of a control for repetitively performing the SIM measurement as shown in FIG. 2 is determined. Further, voltages U, V to be applied to the rod electrodes are automatically derived according to the designated mass values, and therefore a voltage control pattern for the SIM measurement is determined.

Subsequently, when the user issues the instruction on start of the SIM measurement, the control section 10 controls the ion-selecting voltage generation section 13 according to the determined voltage control pattern to appropriately change a voltage (specifically, the DC voltage U and an amplitude of the RF voltage V) to be applied to the rod electrodes 3*a* to 3*d*. As a result, as shown in FIG. 2, when the mass-value difference is relatively larger, the settling time-period becomes relatively short, as compared to when the mass-value difference is relatively small. Further, when the post-change mass value is relatively larger, the settling time-period becomes relatively short, as compared to when the post-change mass value is relatively small. In this example, the interval span Ta is fixed, and thereby the measurement time-period Tdw becomes longer as the settling time-period becomes shorter. Therefore, an ion detection time-period for each of the mass values becomes longer, so that sensitivity and SN ratio are enhanced.

For example, in case where a user sets only the measurement time-period Tdw as an analysis condition without designating or fixing the interval span Ta, the interval span Ta becomes shorter as the settling time-period becomes shorter. This means that the number of repetitions of the interval span Ta per second is increased, or a time interval between adjacent measurements for one (e.g., M11) of the mass values is shortened. Thus, time resolution is enhanced. This makes it possible to accurately analyze a target component contained in a sample gas introduced from the GC into the quadruple mass spectrometer without missing a peak of the target component on a chromatogram even in a situation where an appearance time of the target component is short, i.e., the peak of the target component is sharp.

With reference to FIG. 4, a distinctive control operation for a scan measurement in the quadruple mass spectrometer according to this embodiment will be described below.

Figure 4A:
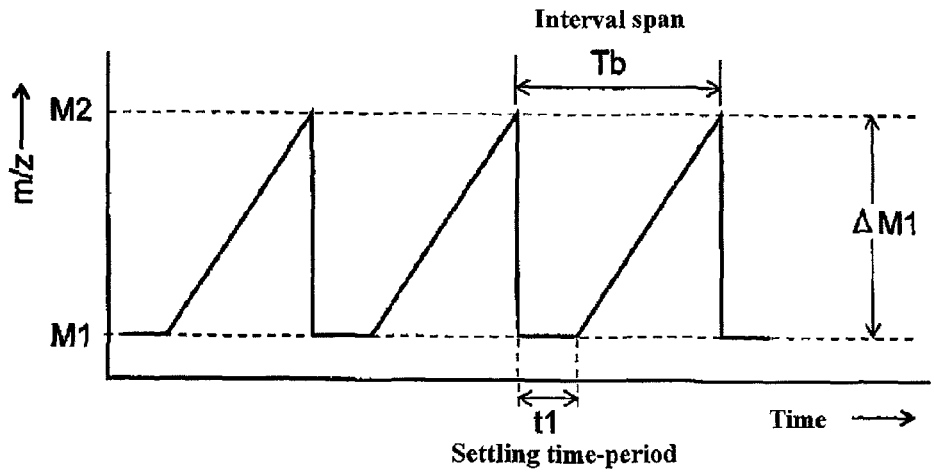
FIGS. 4A to 4C are charts schematically showing a relationship between a mass-value change and a settling time-period in a scan measurement.
Figure 4B:
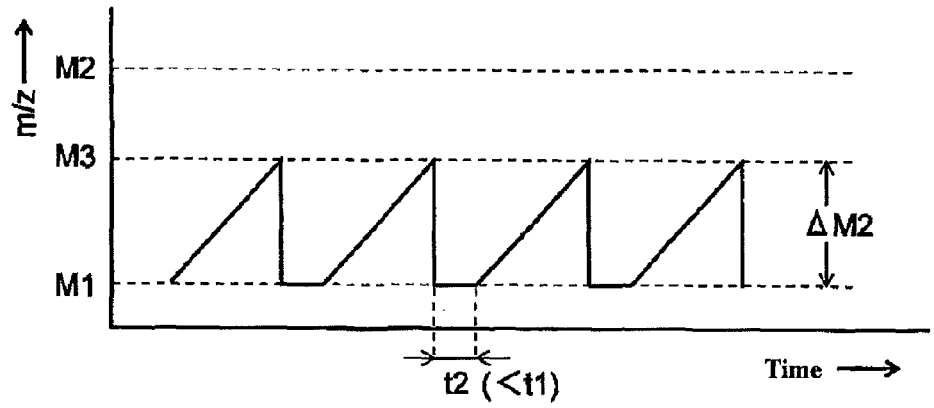
Figure 4C:
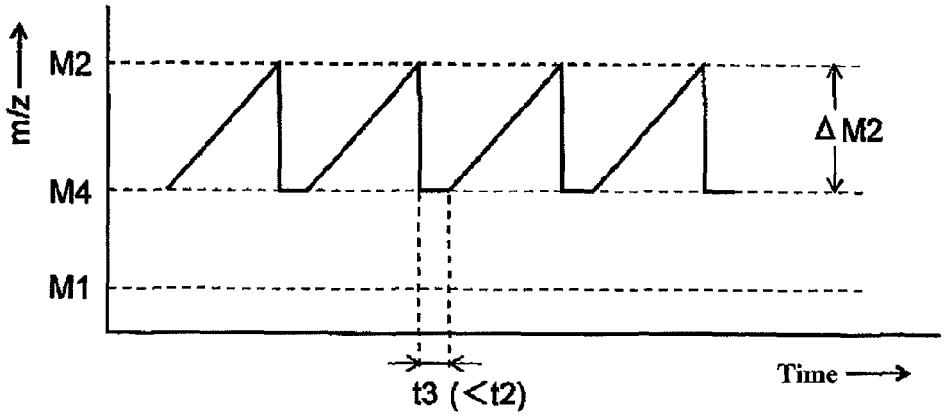

In the scan measurement, in advance to issuing an instruction on start of the scan measurement, a user uses the input section 11 to input and set, as analysis conditions, a scan-start mass value M1, a scan-end mass value M2 and a mass scan time-period (Tdw). In response to this input, the optimal settling-lime calculation sub-section 101 of the control section 10 calculates a mass-value difference ΔM between the scan-start mass value M1 and the scan-end mass value M2, and cross-check the calculated mass-value difference ΔM, and the scan-start mass value M1 (i.e., post-change mass value), with the settling time-period setting table to derive a settling time-period corresponding to them, from the settling time-period setting table. As shown in FIGS. 4A and 4B, even in two cases where the scan-start mass value is commonly set to M1, the settling time-period is set to a shorter value (e.g., t2<t1) as the mass-value difference ΔM becomes smaller (e.g., ΔM2, ΔM1). Further, as shown in FIGS. 4B and 4C, even in two cases where the mass-value difference ΔM is set identically therebetween, the settling time-period is set to a shorter value as the scan-start mass value becomes larger.

Then, the voltage control pattern determination sub-section 102 adds the settling time-period t1 (or t2 or t3) and the mass scan time-period (Tdw) to obtain an interval span Tb. Through the above operation, a time chart of a control for repetitively performing the scan measurement is determined, as shown in any one of FIGS. 4A to 4B. Further, voltages U, V to be applied to the rod electrodes are automatically derived according to the scan-start and scan-end mass values defining a mass scan range (i.e., the mass-value difference ΔM), and therefore a voltage control pattern for the scan measurement is determined.

Subsequently, when the user issues the instruction on start of the scan measurement, the control section 10 controls the ion-selecting voltage generation section 13 according to the determined voltage control pattern to appropriately change a voltage (specifically, the DC voltage U and an amplitude of the RF voltage V) to be applied to the rod electrodes 3*a* to 3*d*. As above, the settling time-period becomes shorter as the mass scan range becomes narrower, or the scan-start mass value becomes larger, and thereby the interval span Ta becomes shorter, so that time resolution is enhanced. This makes it possible to accurately analyze a target component contained in a sample gas introduced from the GC into the quadruple mass spectrometer without missing a peak of the target component on a chromatogram even in a situation where an appearance time of the target component is short, i.e., the peak of the target component is sharp.

Further, in case where the interval span Tb or the number of mass scan cycles per second is fixed, the mass scan time-period becomes longer as the settling time-period becomes shorter, and thereby an ion detection time-period for one mass value becomes longer. This makes it possible to enhance sensibility and SN ratio.

The above embodiment has been described based on one example where the above control operation is applied to the SIM measurement and the scan measurement. It is understood that the control operation of changing a length of the settling time-period depending on a mass-value difference and a next-measurement mass value is also effective in a mode of repetitively carrying out an MRM measurement in MS/MS analysis.

Further, a direction of mass scan in the scan measurement, and an order (i.e., descending or ascending order) of mass scan for the plurality of mass values in one interval span in the SIM measurement, are not particularly limited.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A method of controlling a quadruple mass spectrometer equipped with a quadrupole mass filter for allowing an ion having a specific mass to selectively pass therethrough and a detector for detecting the ion passing through the quadrupole mass filter, and designed to perform one of: a scan measurement configured to continuously change a mass value for an ion to be allowed to pass through the quadrupole mass filter, over a given mass range, in a repetitive manner; a selected ion monitoring (SIM) or multiple reaction monitoring (MRM) measurement configured to carry out a cycle of operation to sequentially change between a plurality of pre-set mass values, in a repetitive manner; and an alternate measurement configured to alternately carry out the scan measurement and the SIM or MRM measurement, the method comprising:

(a) applying a given voltage to four electrodes constituting the quadrupole mass filter; and (b) during one of the scan measurement, the SIM or MRM measurement and the alternate measurement, changing the voltage to be applied to the electrodes of the quadrupole mass filter, according to a discrete change in mass value, while changing a length of a waiting time-period from just after the discrete change through until a substantial ion detection operation is started, based on a difference between respective mass values before and after the discrete change, and the mass value after the discrete change so that the waiting time-period becomes shorter as the mass value after the discrete change in mass value becomes larger.

2. The method as defined in claim 1, further comprising changing the voltage to be applied to the electrodes of the quadrupole mass filter so that the waiting time-period becomes shorter as the difference between the respective mass values before and after the discrete change in mass value becomes smaller.

* * * * *